US007241114B2

(12) United States Patent
Koeppler

(10) Patent No.: US 7,241,114 B2
(45) Date of Patent: Jul. 10, 2007

(54) ROTOR FOR A CENTRIFUGAL PUMP

(75) Inventor: Peter Koeppler, Bad Vilbel (DE)

(73) Assignee: Siemens AG, München (DE)

( * ) Notice: Subject to any disclaimer, the term of this patent is extended or adjusted under 35 U.S.C. 154(b) by 21 days.

(21) Appl. No.: 11/113,010

(22) Filed: Apr. 25, 2005

(65) Prior Publication Data

US 2005/0191176 A1 Sep. 1, 2005

Related U.S. Application Data

(63) Continuation of application No. PCT/DE03/03182, filed on Sep. 24, 2003.

(30) Foreign Application Priority Data

Oct. 30, 2002 (DE) ..... 102 50 776

(51) Int. Cl.
*F04D 29/24* (2006.01)

(52) U.S. Cl. ..... 416/186 R; 416/188; 416/223 B; 416/242

(58) Field of Classification Search ..... 416/185, 416/186 R, 188, 223 B, 238, 242, 243, DIG. 2
See application file for complete search history.

(56) References Cited

U.S. PATENT DOCUMENTS

| | | | | | |
|---|---|---|---|---|---|
| 1,050,523 | A | | 1/1913 | Dixon | |
| 3,433,145 | A | * | 3/1969 | Daly et al. | 416/186 R |
| 3,444,817 | A | | 5/1969 | Caldwell | |
| 5,242,268 | A | * | 9/1993 | Fukazawa et al. | 416/188 |
| 5,478,201 | A | * | 12/1995 | Amr | 416/186 R |
| 5,730,582 | A | | 3/1998 | Heitmann | |
| 5,988,979 | A | * | 11/1999 | Wang | 416/186 R |

FOREIGN PATENT DOCUMENTS

| | | | | | |
|---|---|---|---|---|---|
| DE | G 92 06 053.6 | U1 | | 8/1992 | |
| EP | 0 511 594 | A1 | | 11/1992 | |
| GB | 336 977 | | | 4/1929 | |
| GB | 859 815 | A | | 1/1961 | |
| JP | 59168297 | A | | 9/1984 | |
| JP | 59192898 | A | | 11/1984 | |
| JP | 01-302000 | A | * | 12/1989 | 416/185 |
| SU | 1528965 | A | * | 12/1989 | 416/242 |

OTHER PUBLICATIONS

Abstract—G 92 06 053.6 U1 Aug. 13, 1992 Zanussi Elettrodomestici S.p.A., Pordenone, IT.
XP 009025935—Karl Pfleiderer et al.
Abstract—XP 009025935 Karl Pfleiderer et al.

* cited by examiner

*Primary Examiner*—Richard A. Edgar

(57) ABSTRACT

The invention relates to a rotor having at least three blades disposed between a front cover plate and a rear cover plate, the art of the suction edge of at least one blade, in the top view of the inlet side of the pumping medium, following a sinusoidal path with a single turning point W. The present invention is also directed to the use of the rotor in a centrifugal pump to pump coolant in a motor vehicle.

5 Claims, 2 Drawing Sheets

ROTOR FOR A CENTRIFUGAL PUMP

CROSS REFERENCE TO RELATED APPLICATIONS

The present application is a continuation of International Application Ser. No. PCT/DE2003/03182, filed Sep. 24, 2003, which designated the United States and further claims priority to German patent application 10250776.7, filed Oct. 30, 2002, the both of which are herein incorporated by reference.

BACKGROUND OF THE INVENTION

The invention relates to a rotor for a centrifugal pump and to a use of the rotor.

Rotors for centrifugal pumps are known. They are provided with blades through which the pumping medium, which is introduced perpendicular to the blades, is diverted in the radial direction and is led off laterally from the rotor to the pressure branch pipe of the centrifugal pump. A particularly high importance is herein attached to the structural design of the blades. In "Strömungsmaschinenn" by Karl Pfleiderer, Hartwig Petermann, 6th edition, pages 156 to 165, aspects are set out according to which the blades should be structured. It is herein emphasized, for example, that the path of the suction edge of the blade should be chosen such that it connects to the side walls at the steepest possible angles, at sufficient distance from the pressure edge.

SUMMARY OF THE INVENTION

The object of the invention is to provide a rotor for a centrifugal pump, in which a relatively high efficiency is achievable, even in smaller constructions.

The object forming the basis of the invention is achieved by a rotor for a centrifugal pump, in which there are at least three blades disposed between a front cover plate and a rear cover plate, the arc of the suction edge of at least one blade, in the top view of the inlet side of the pumping medium, following a sinusoidal path with a single turning point W. The suction edge is herein defined as that edge of each and every blade which is facing the flowing medium. As pumping media, liquids, gases or even, for example, suspensions may be used. The turning point is herein defined as that point on the arc which separates two parts of different curvature. Here, the arc-shaped path is meant which presents itself to the observer in the top view of the inlet side of the pumping medium. It has surprisingly been shown that the rotor, even in the case of smaller structural designs, has a relatively high efficiency. This is obtained, for example, when the diameter of the rotor measures between 5 and 6 cm. The larger the structural design of the rotor for the centrifugal pump, the higher is the efficiency. By efficiency should here be understood, for example, the quotient of the drawn-off hydraulic power and the supplied power, the drawn-off hydraulic power being defined as the product of throughput and pressure difference. In most cases, both an increase in throughput and an increase in pressure difference can thereby be obtained.

A preferred embodiment of the invention consists in the turning point W lying nearer to the inner end B of the arc of the suction edge than to the outer end A of the arc of the suction edge. The efficiency can be raised still further as a result of this measure.

According to a further preferred embodiment of the invention, 7 to 15 blades are provided. Particularly advantageously, the rotor for a centrifugal pump is hence suitable for a variety of applications.

According to a further preferred embodiment of the invention, it is envisaged that the arcs of the suction edges of all blades are similarly configured. By similar configuration should here be understood that the arcs of the suction edges of all blades, in the top view of the inlet side of the pumping medium, follow a sinusoidal path with a single turning point W. As a result of this measure, the efficiency is likewise increased and the production of the rotor simultaneously simplified.

According to a further preferred embodiment of the invention, it is envisaged that all inner ends B of the arcs of the suction edges, with respect to the top view of the inlet side of the pumping medium, lie on a circle. This optimizes the flow characteristics inside the rotor for the centrifugal pump.

According to a further preferred embodiment of the invention, that side of the rear cover plate which is facing the direction of flow of the pumping medium is of convex configuration. The provision of an otherwise customary intake spinner in the form of a bead-like projection is in this case dispensed with. The convex configuration improves the flow characteristics in the region of the rear cover plate.

According to a further embodiment of the invention, that side of the rear cover plate which is facing the direction of flow of the pumping medium has, in the middle, a plane surface. A storage space is thereby created on the plane surface, in which eddies are formed by which the flowing medium can make its way laterally to the outlet of the rotor in a preferred manner.

Finally, the subject of the invention is the use of the rotor in a centrifugal pump to pump coolant in a motor vehicle. This allows improved cooling in the motor vehicle, which is a direct consequence of the increased efficiency produced by the rotor for a centrifugal pump.

BRIEF DESCRIPTION OF THE SEVERAL VIEWS OF THE DRAWINGS

The invention is explained in greater detail below, and on an illustrative basis, with reference to the drawing (FIG. 1 to FIG. 3).

DETAILED DESCRIPTION OF THE INVENTION

Figure 1:
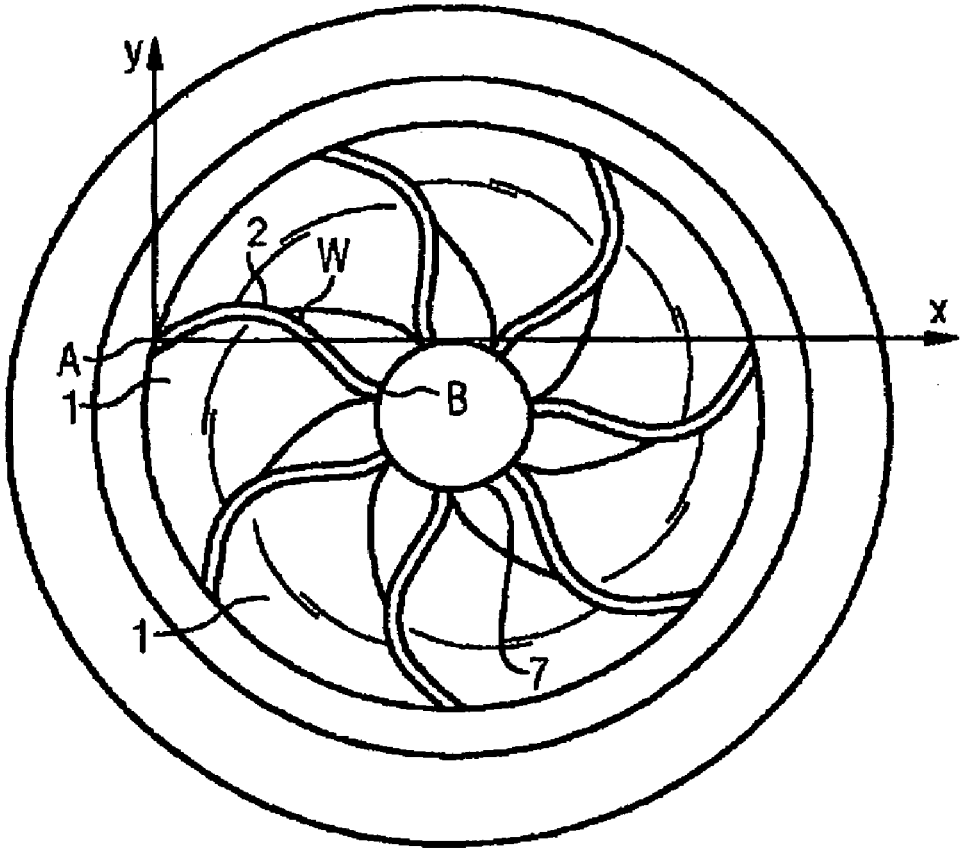
FIG. 1 shows the rotor for a centrifugal pump in top view.

In FIG. 1, the rotor for a centrifugal pump is represented in top view. The rotor has a plurality of blades 1, the arc 2 of the suction edge of the blades 1 following a sinusoidal path with a single turning point W. The sinusoidal path is illustrated by the system of coordinates having the abscissa X and the ordinate Y. The turning point W in this case lies nearer to the inner end B of the arc 2 of the suction edge than to the outer end A of the arc 2 of the suction edge. All in all, seven blades 1 are provided. The arcs 2 of the suction edges of all blades 1 are here similarly configured. All inner ends B of the arcs 2 of the suction edges, with respect to the top view of the inlet side of the pumping medium, lie on a circle 7.

Figure 2:
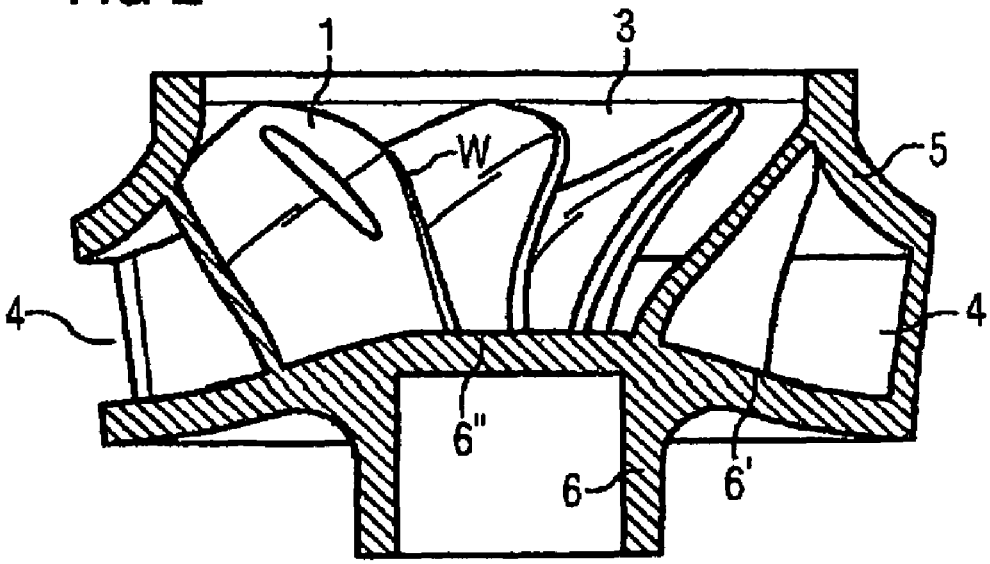
FIG. 2 shows the rotor for a centrifugal pump in cross section.

In FIG. 2, the rotor for a centrifugal pump is represented in cross section. In the middle, it has an inlet side 3 for the pumping medium. The pumping medium flows through the rotor for the centrifugal pump and makes its way via the outlet 4 of the rotor to the pressure branch pipe of the centrifugal pump (not represented). That side 6' of the rear cover plate 6 which is facing the direction of flow of the pumping medium is of convex configuration and has, in the middle, a plane surface 6". During operation, a storage space for the pumping medium is formed on this plane surface 6", so that the medium can reach the outlet side 4 of the rotor more quickly. The individual blades 1 are disposed between the front cover plate 5 and the rear cover plate 6.

Figure 3:
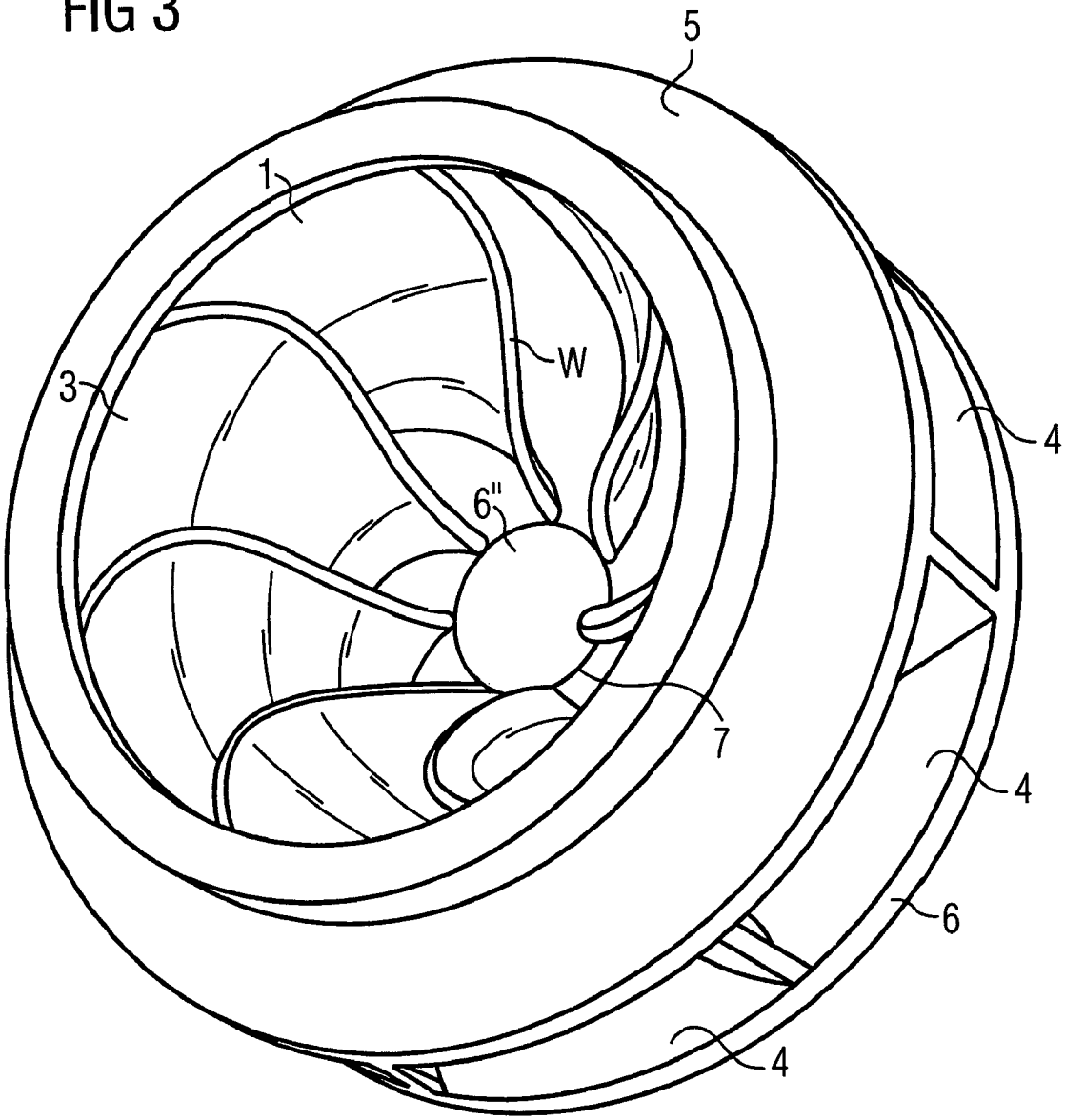
FIG. 3 shows the rotor for a centrifugal pump in three-dimensional representation.

In FIG. 3, the rotor for a centrifugal pump is represented three-dimensionally. It is generally made of plastic. Particularly advantageously, thermosetting plastics here find application. The rotor in a centrifugal pump is used, particularly advantageously, to pump coolant in a motor vehicle. The diameter of the rotor then lies between 4 and 7 cm. Although such a rotor is shaped relatively small, a relatively high efficiency of the centrifugal pump can still be achieved.

The invention claimed is:

1. A rotor for a centrifugal pump, comprising:

a front cover plate at an inlet side and having an opening for receiving a pumping medium;

a rear cover plate positioned opposite the front cover plate, the rear cover plate comprising a side facing a direction of flow of the pumping medium, the side comprising a convex configuration having a flat plane surface in the middle;

at least three blades disposed between the front cover plate and the rear cover plate, each of the at least three blades comprising a suction edge having an arc following a sinusoidal path with a single turning point when viewed from the inlet side in a direction of flow of the pumping medium, each arc comprising an inner end and an outer end, the inner end of each arc lying on a circle on the flat plane surface.

2. The rotor according to claim 1, wherein the turning point of each arc lies nearer to the inner end than to the outer end.

3. The rotor according to claim 1, wherein the at least three blades comprises 7 to 15 blades.

4. The rotor according to claim 1, wherein all arcs of all suction edges of all blades are similarly configured.

5. The rotor according to claim 1, wherein the pumping medium is motor vehicle coolant.

* * * * *